US009475299B2

(12) United States Patent
Kosuge

(10) Patent No.: US 9,475,299 B2
(45) Date of Patent: Oct. 25, 2016

(54) TAPE PRINTER

(71) Applicant: Seiko Epson Corporation, Tokyo (JP)

(72) Inventor: Shinsaku Kosuge, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/048,337

(22) Filed: Feb. 19, 2016

(65) Prior Publication Data

US 2016/0167388 A1 Jun. 16, 2016

Related U.S. Application Data

(63) Continuation of application No. 14/790,281, filed on Jul. 2, 2015, now Pat. No. 9,296,222.

(30) Foreign Application Priority Data

Aug. 5, 2014 (JP) ..... 2014-159229

(51) Int. Cl.
*B41J 2/175* (2006.01)
*B41J 3/407* (2006.01)
*B41J 15/04* (2006.01)

(52) U.S. Cl.
CPC ..... *B41J 2/1752* (2013.01); *B41J 3/4075* (2013.01); *B41J 15/044* (2013.01)

(58) Field of Classification Search
CPC ..... B41J 11/007; B41J 11/42; B41J 3/4075; B41J 3/4078
See application file for complete search history.

(56) References Cited

U.S. PATENT DOCUMENTS 8,662,661 B2 * 3/2014 Yamamoto ..... B41J 29/13 347/108
8,708,469 B2 * 4/2014 Kodama ..... B41J 2/1752 347/50
9,067,441 B2 * 6/2015 Tanaka ..... B41J 11/22
9,180,671 B2 * 11/2015 Suzuki ..... B41J 29/02

FOREIGN PATENT DOCUMENTS

JP 2002-167084 A 6/2002
JP 2003-237177 A 8/2003

OTHER PUBLICATIONS

Notice of Allowance and Notice of Allowability received in U.S. Appl. No. 14/790,281, Dec. 8, 2015.

* cited by examiner

*Primary Examiner* — Lamson Nguyen
(74) *Attorney, Agent, or Firm* — ALG Intellectual Property, LLC

(57) ABSTRACT

A tape printer includes a cartridge installation portion to install a tape cartridge, an opening/closing cover that rotates about a hinge portion to open/close the cartridge installation portion, a cover urging portion that rotates and urges the opening/closing cover in an opening direction in a state in which the opening/closing cover is rotated to an opening side to get across a prescribed rotation position and that rotates and urges the opening/closing cover in a closing direction in a state in which the opening/closing cover is rotated to a closing side to get across the prescribed rotation position, and a cover opening operation portion that has an opening button and rotates the opening/closing cover to the opening side to get across the prescribed rotation position with a force to press the opening button. The cover opening operation portion has the opening button, a leverage member, and a rotation spring.

1 Claim, 10 Drawing Sheets

TAPE PRINTER

CROSS REFERENCES TO RELATED APPLICATIONS

The present application is a continuation application of U.S. patent application Ser. No. 14/790,281 filed Jul. 2, 2015, which claims priority from Japanese Patent Application No. 2014-159229 filed Aug. 5, 2014, which are expressly incorporated by reference herein.

BACKGROUND

1. Technical Field

The present invention relates to a tape printer having a cartridge installation portion to install a tape cartridge and an opening/closing cover to open/close the cartridge installation portion.

2. Related Art

Conventionally, as such a tape printer, there has been known one having a cartridge installation portion to install a tape cartridge, an opening/closing cover that rotates about a hinge portion to open/close the cartridge installation portion, a rib-shaped projection provided on the opening/closing cover, an engagement lever that engages with the rib-shaped projection and is freely rotatable about a shaft parallel to the hinge portion, and a pressing spring to urge the engagement lever in an engagement direction (see JP-A-2003-237177). In the tape printer, the pressing spring urges the opening/closing cover in a closing direction via the engagement lever and the rib-shaped projection in a state in which the opening/closing cover is closed to get across a prescribed closing-side rotation position, while the pressing spring urges the opening/closing cover in an opening direction via the engagement lever and the rib-shaped projection in a state in which the opening/closing cover is opened to get across the prescribed closing-side rotation position.

In the tape printer described above, since the opening/closing cover is urged in the opening direction when being opened to get across the prescribed closing-side rotation position, it may pop up to the opening side. On the other hand, since the opening/closing cover is urged in the closing direction when being closed to get across the prescribed closing-side rotation position, it may remain closed. Moreover, since the closed opening/closing cover is urged in the closing direction, the rattling of the closed opening/closing cover may be prevented. For example, in a case in which an operation portion such as a function button is provided on the opening/closing cover, the rattling of the opening/closing cover due to the operation of the operation portion is prevented.

However, in the tape printer described above, the closed opening/closing cover is urged in the closing direction. Therefore, in order to open the closed opening/closing cover, there is need to hold the opening/closing cover and lift up the same to the prescribed closing-side rotation position. In addition, since the closed opening/closing cover is urged in the closing direction, a printer main body is also lifted up when the opening/closing cover is lifted up. Therefore, there is need to lift up the opening/closing cover by one hand while holding the printer main body by the other hand. Thus, the tape printer described above suffers from the problem that the opening of the opening/closing cover is complicated.

An advantage of an aspect of the present invention is to provide a tape printer that may facilitate the opening of an opening/closing cover, the tape printer being configured such that the opening/closing cover is opened and urged in a state in which the opening/closing cover is opened to get across a prescribed rotation position and that the opening/closing cover is closed and urged in a state in which the opening/closing cover is closed to get across the prescribed rotation position.

SUMMARY

According to an aspect of the present invention, there is provided a tape printer including: a cartridge installation portion to install a tape cartridge; an opening/closing cover that rotates about a hinge portion to open/close the cartridge installation portion; a cover urging portion that rotates and urges the opening/closing cover in an opening direction in a state in which the opening/closing cover is rotated to an opening side to get across a prescribed rotation position and that rotates and urges the opening/closing cover in a closing direction in a state in which the opening/closing cover is rotated to a closing side to get across the prescribed rotation position; and a cover opening operation portion that has an opening button and rotates the opening/closing cover to the opening side to get across the prescribed rotation position with a force to press the opening button.

According to the configuration, when the opening button is pressed in a state in which the cartridge installation portion is closed with the opening/closing cover, the cover opening operation portion may open the opening/closing cover to get across the prescribed rotation position with the pressing force. As described above, since the cover opening operation portion opens the opening/closing cover to a position at which the opening/closing cover is opened and urged with the force to press the opening button, a user is allowed to open the opening/closing cover only by pressing the opening button. That is, the user is allowed to easily open the opening/closing cover only by a finger. Thus, the usability of the tape printer may be improved.

In this case, the tape printer preferably further includes a cover locking portion to lock the opening/closing cover in a state in which the cartridge installation portion is covered.

According to the configuration, the opening of the opening/closing cover due to impact or the like may be prevented.

In addition, the cover locking portion preferably unlocks the opening/closing cover with the force to press the opening button.

According to the configuration, since the opening/closing cover may be unlocked with the force to press the opening button, the user is allowed to unlock and open the opening/closing cover only by pressing the opening button. Accordingly, the user does not feel burdened on operating the unlocking of the opening/closing cover. Therefore, the usability may be further improved. Note that the unlocking of the opening/closing cover with the cover locking portion and the rotation of the opening/closing cover with the cover opening operation portion are preferably linked together. That is, the rotation of the opening/closing cover with cover opening operation portion is preferably performed after the unlocking of the opening/closing cover.

On the other hand, the cover opening operation portion has the opening button and a leverage member that is rotatably supported by a rotation shaft and converts the force to press the opening button into a force to press the opening/closing cover in the opening direction when the opening button abuts on the leverage member.

According to the configuration, the cover opening operation portion may be simplified in configuration.

DESCRIPTION OF EXEMPLARY EMBODIMENTS

Hereinafter, a description will be given of an embodiment of the present invention with reference to the accompanying drawings. The tape printer performs printing on a print tape while feeding out the same from a tape cartridge and cuts off a printed part of the print tape to create a label (tape piece). In particular, the tape printer may facilitate the opening of an opening/closing cover while preventing the rattling of the opening/closing cover provided at a cartridge installation portion.

Figure 1:
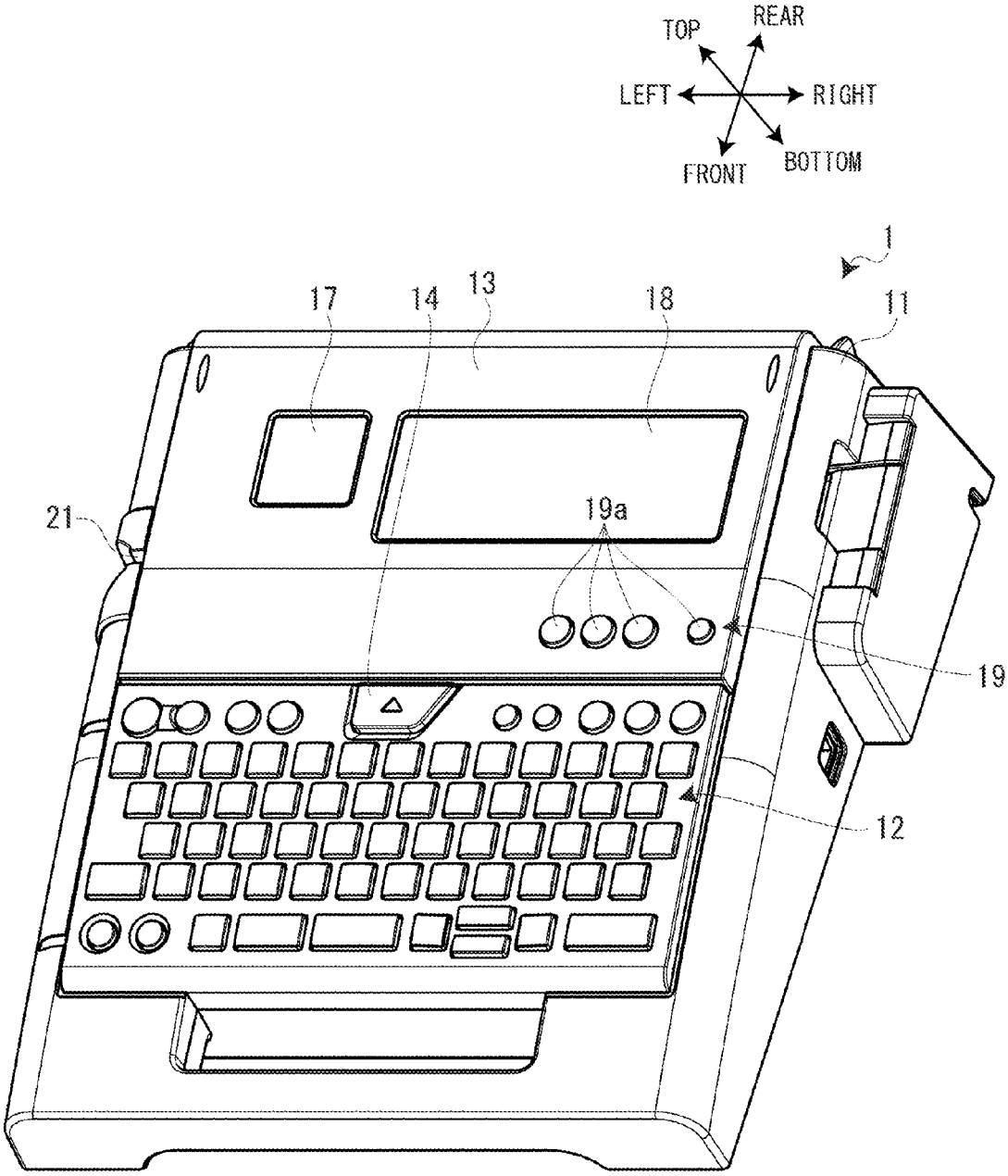
FIG. 1 is an external perspective view showing a tape printer according to an embodiment of the present invention.
Figure 2:
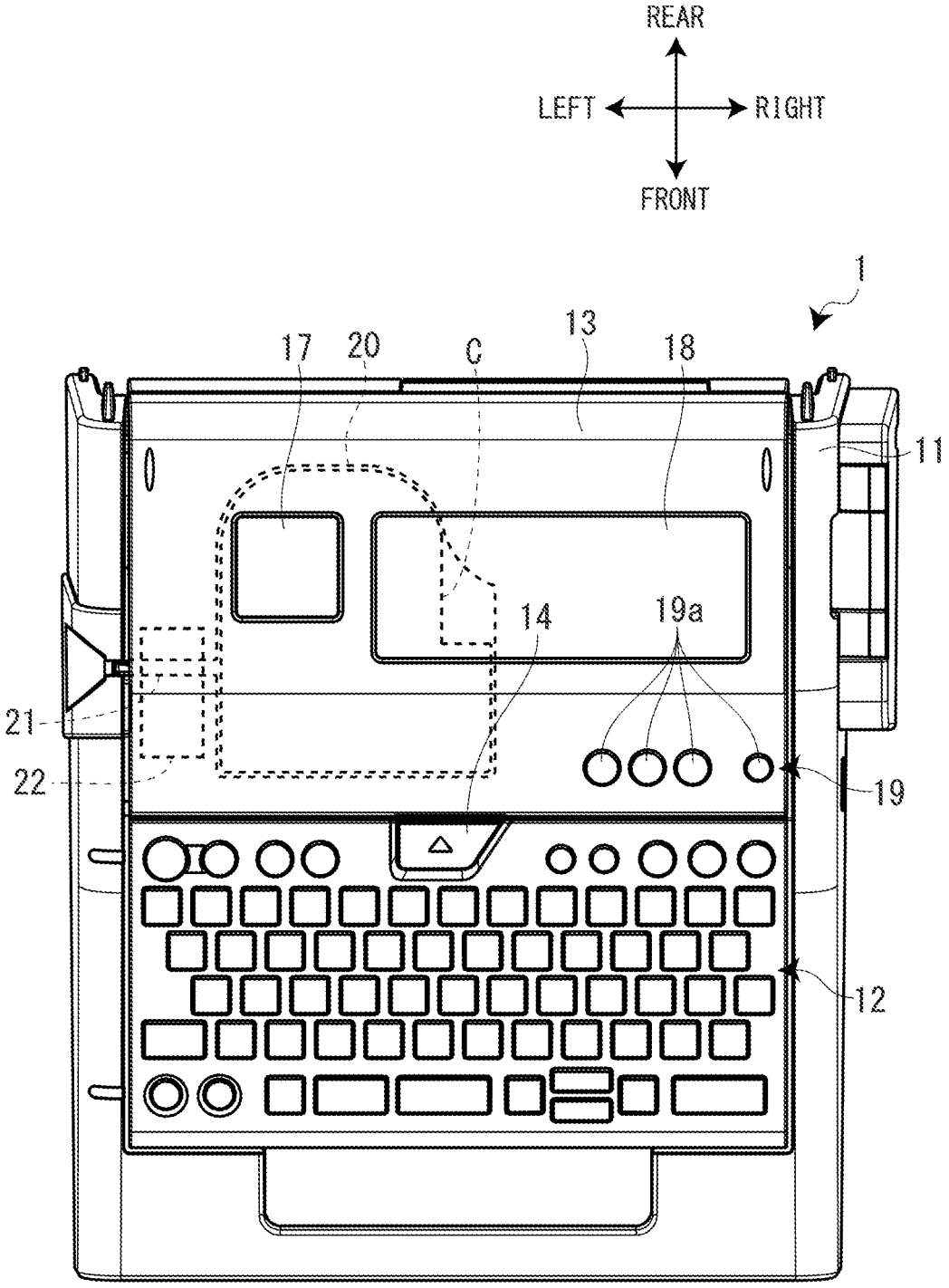
FIG. 2 is a plan view showing the tape printer.

As shown in FIGS. 1 and 2, the outer shell of a tape printer 1 is formed by a printer case 11 attached to a printer frame (not shown), and a keyboard 12 having various keys is provided at the front half part of the upper surface of the printer case 11. In addition, an opening/closing cover 13 is widely provided at the rear half part of the upper surface of the printer case 11. In addition, an opening button 14 to open the opening/closing cover 13 is provided adjacent to the opening/closing cover 13 on the front side of the opening/closing cover 13.

The opening/closing cover 13 is rotatably attached to the printer frame via a hinge portion 50 (FIGS. 4A and 4B) provided on its rear side, i.e., the opening/closing cover 13 is attached so as to be freely openable/closable. On the opening/closing cover 13, a check window 17 and a display 18 to indicate an input result via the keyboard 12 are provided side by side in a right and left direction. In addition, at the right front part of the opening/closing cover 13, a button group 19 composed of four function buttons 19*a* is provided. Note that as will be described in detail later, a rib-shaped projection 51, a latched portion 52, and a pressed portion 53 each associated with the opening/closing structure of the opening/closing cover 13 are formed at the inner surface (lower surface) of the opening/closing cover 13.

As shown in FIG. 2, a cartridge installation portion to install a tape cartridge C is recessed on the inner side of the opening/closing cover 13, and the tape cartridge C is attachably/detachably installed in the cartridge installation portion 20 in a state in which the opening/closing cover 13 is opened. That is, the opening/closing cover 13 is used to open/close the opening part of the cartridge installation portion 20. In addition, the tape cartridge C installed in the cartridge installation portion 20 may be visually checked via the check window 17.

On the left side of the printer case 11, a tape ejection port 21 to communicate the cartridge installation portion with an outside is formed. In addition, a tape cutter 22 to cut off a printed part of the print tape T is provided so as to face the tape ejection port 21.

Figure 3A:
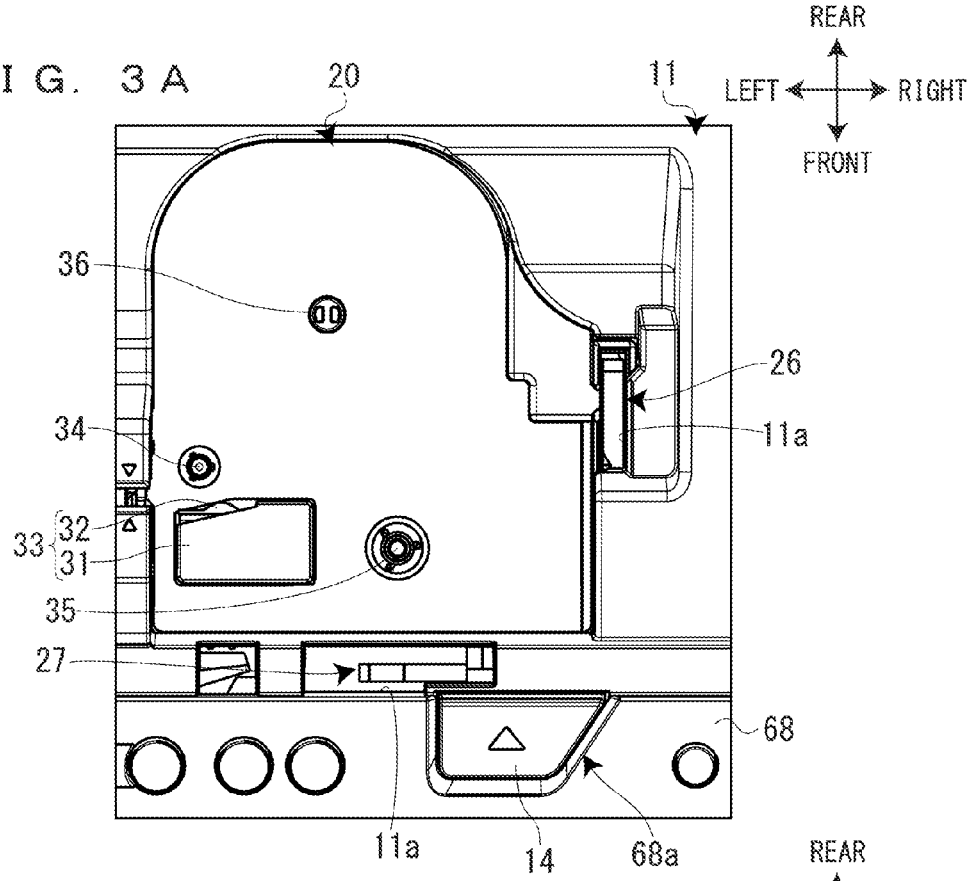
FIGS. 3A and 3B are plan views showing the vicinity of a cartridge installation portion.
Figure 3B:
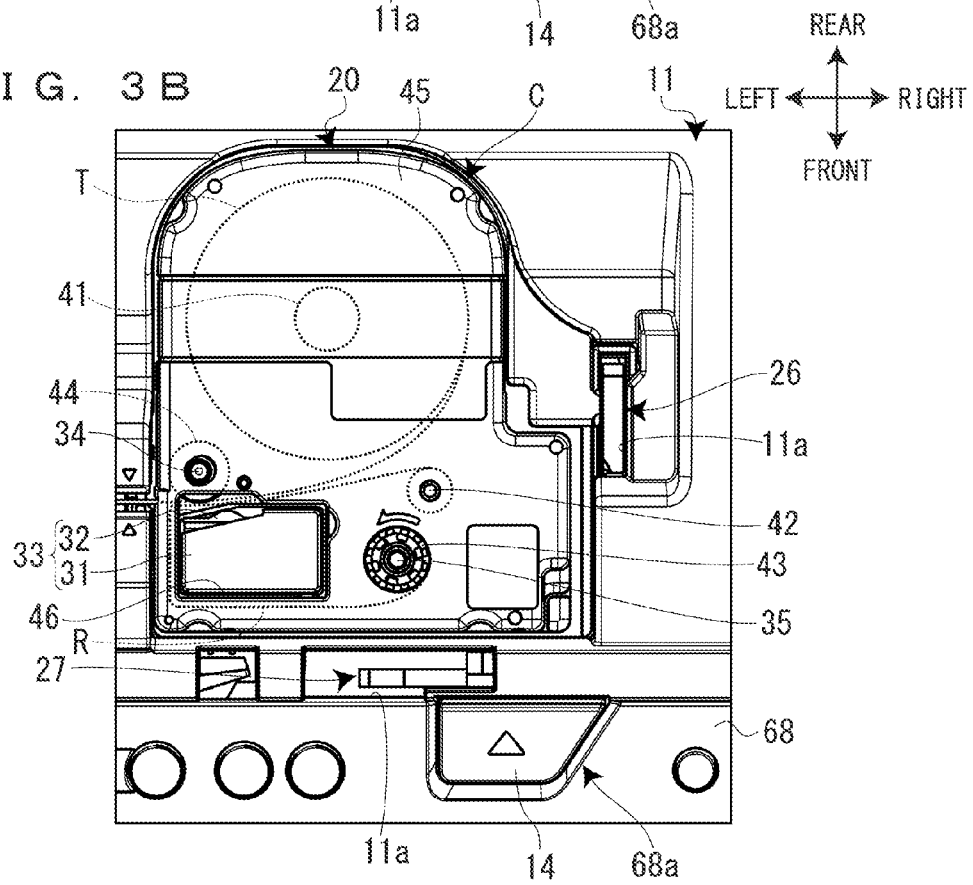

Here, a description will be given, with reference to FIGS. 3A and 3B, of a structure in the vicinity of the cartridge installation portion 20 in the tape printer 1. FIGS. 3A and 3B are views showing the vicinity of the cartridge installation portion 20 in a state in which the opening/closing cover 13 is opened. FIG. 3A shows the vicinity of the cartridge installation portion 20 in a state in which the tape cartridge C is not installed. FIG. 3B shows the vicinity of the cartridge installation portion 20 in a state in which the tape cartridge C is installed.

As shown in FIGS. 3A and 3B, the tape printer 1 has the cartridge installation portion 20, a cover urging portion 26 provided adjacent to the right side of the cartridge installation portion 20, and a cover locking/pressing-up portion 27 provided adjacent to the front side of the cartridge installation portion 20. A "cover opening operation portion" is constituted by the opening button 14 and the cover locking/pressing-up portion 27. In addition, the "cover locking portion" is constituted by the cover locking/pressing-up portion 27. As will be described in detail later, the cover urging portion 26 engages with the rib-shaped projection 51 of the opening/closing cover 13 to rotate and urge the opening/closing cover 13. In addition, the cover locking/pressing-up portion 27 latches the latched portion 52 to lock the opening/closing cover 13 in a state in which the cartridge installation portion 20 is closed (closed state) and presses the pressed portion 53 to press up the opening/closing cover 13. Note that the cover urging portion 26 and the cover locking/pressing-up portion 27 are provided inside the printer case 11 as shown in FIGS. 3A and 3B. Further, the rib-shaped projection 51, the latched portion 52, and the pressed portion 53 reach the cover urging portion 26 and the cover locking/pressing-up portion 27 via respective penetration openings 11*a* provided in the printer case 11.

As shown in FIG. 3A, the cartridge installation portion 20 has a head unit 33 in which a thermal-type print head 32 is embedded inside a head cover 31, a platen driving shaft 34 opposing the print head 32, a winding-up driving shaft 35 to wind up an ink ribbon R that will be described later, a positioning projection 36 for a tape reel 41 that will be described later.

Meanwhile, as shown in FIG. 3B, the tape cartridge C has the tape reel 41 on which the print tape T is wound, a ribbon reel 42 on which the ink ribbon R is wound, a ribbon winding-up reel 43 to wind up the ink ribbon R, the platen roller 44 opposing the print head 32, and a cartridge case 45 accommodating the above components. In addition, a head opening 46 to receive the head unit 33 is vertically provided in the cartridge case 45 so as to penetrate.

When the tape cartridge C is installed in the cartridge installation portion 20, the head opening 46, the central hole of the tape reel 41, the central hole of the platen roller 44, and the central hole of the ribbon winding-up reel 43 are inserted in the head cover 31, the positioning projection 36, the platen driving shaft 34, and the winding-up driving shaft 35, respectively. The print tape T is fed out from the tape reel 41, while the ink ribbon R is fed out from the ribbon reel 42. Further, after the print tape T and the ink ribbon R overlap together and run side by side at the position of the head opening 46, the print tape T is fed out to the tape ejection port 21 and the ink ribbon R is wound up by the ribbon winding-up reel 43. The print tape T and the ink ribbon R are pressed by the platen roller 44 to the print head 32 at the position at which they run side by side and fed out by the rotation of the platen roller 44 to perform printing. A printed part of the print tape T after undergoing the printing is fed out to the tape ejection port 21 and cut off by the tape cutter 22 to create a label.

Figure 4A:
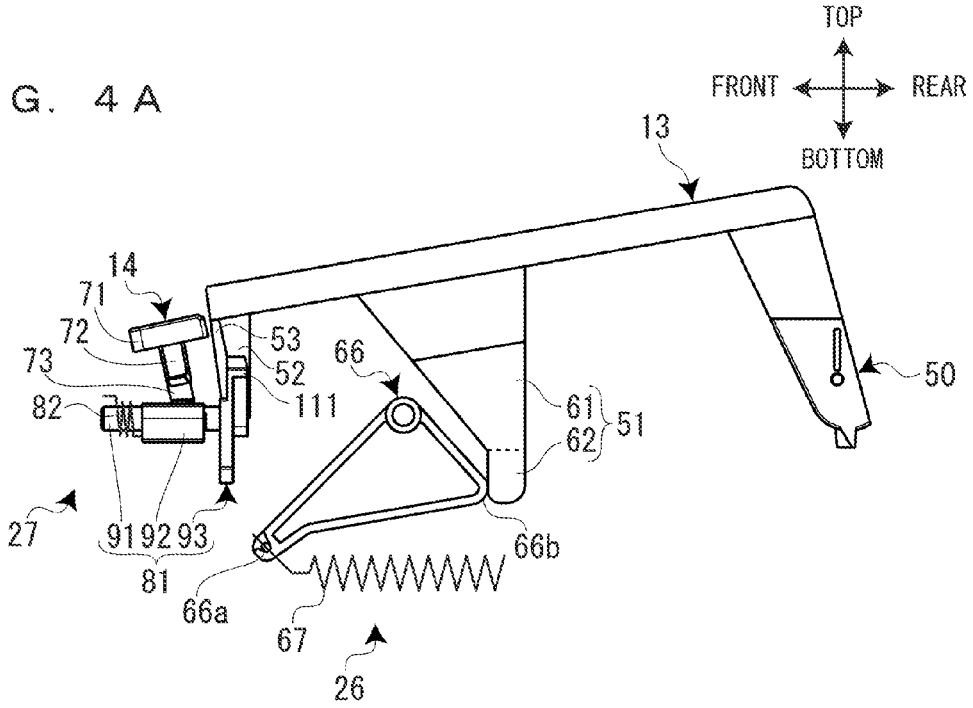
FIGS. 4A and 4B are a side view and a front view showing respective components associated with the opening/closing structure of an opening/closing cover.
Figure 4B:
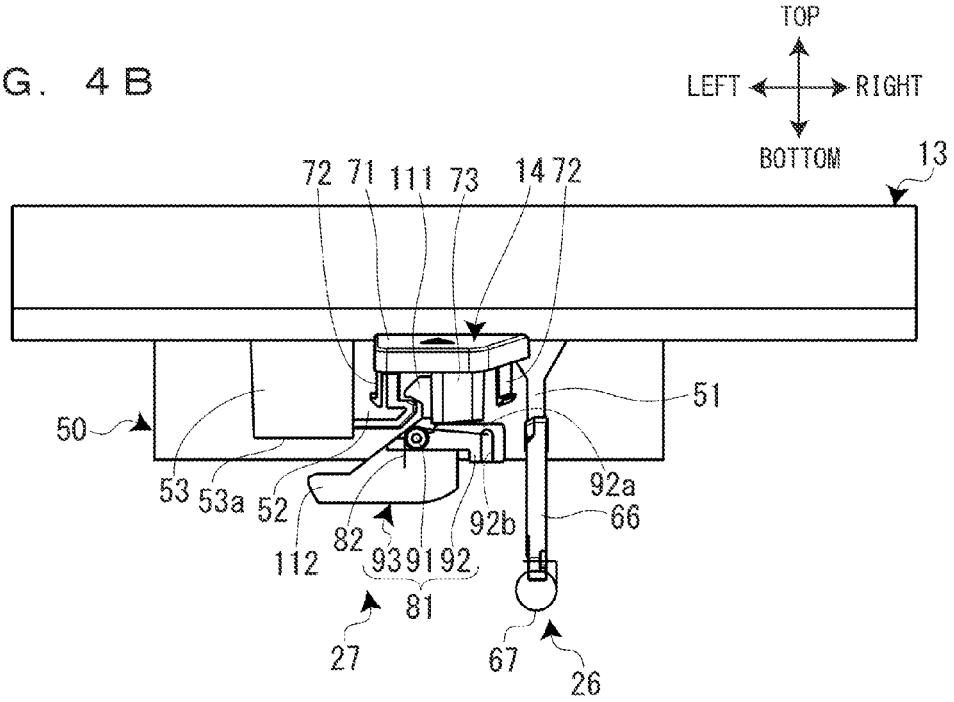

Next, a description will be given of the opening/closing structure of the opening/closing cover 13 with reference to FIGS. 4A and 4B. FIGS. 4A and 4B are views showing the opening/closing cover 13, the cover urging portion 26, the opening button 14, and the cover locking/pressing-up portion 27 each associated with the opening/closing structure of the opening/closing cover 13. Note that FIGS. 4A and 4B omit the check window 17, the display 18, and the button group 19 of the opening/closing cover 13 to simply show the opening/closing cover 13.

As shown in FIGS. 4A and 4B, the opening/closing cover 13 is rotatably attached to the printer frame via the hinge portion 50, i.e., the opening/closing cover 13 is rotatable in a top and bottom direction about the hinge portion 50. The cartridge installation portion 20 is opened/closed with the rotation. In addition, the opening/closing cover 13 has the plate rib-shaped projection 51, the downward hooked latched portion 52, and the downward table pressed portion 53 on its inner surface.

The rib-shaped projection 51 is provided at a position substantially central in the right and left direction of the opening/closing cover 13 and opposing the cover urging portion 26 and formed into a plate shape (rib shape). In addition, the rib-shaped projection 51 is constituted by a barrel portion 61 having a right-angled triangle in a side view and an abutted portion 62 projecting from the tip end (lower end) of the barrel portion 61. The tip end of the abutted portion 62 is formed into an arc shape.

The latched portion 52 and the pressed portion 53 are provided so as to oppose the cover locking/pressing-up portion 27 at the tip end of the opening/closing cover 13. The latched portion 52 is formed into a downward hooked shape, and the pressed portion 53 is formed into a downward table shape having a lower end surface 53*a* as a pressed surface. Note that the pressed portion 53 also functions as a detected portion to detect the opening/closing of the opening/closing cover 13 with a detection sensor (not shown).

The cover urging portion 26 has an engagement lever 66 rotatably supported about a shaft parallel to the hinge portion 50 and an urging spring 67 to rotate and urge the engagement lever 66.

The engagement lever 66 is formed into a substantially right-angled triangle in a side view (when seen from the side of the tape ejection port 21) with its top at a right angle and is rotatably attached to the printer frame at the top. In addition, one of the lower angle portions (front side) of the engagement lever 66 is formed to slightly project and has a spring hooking hole 66*a*. Moreover, the other of the lower angle portions (rear side) of the engagement lever 66 is chamfered, and a rounded portion 66*b* abuts on (contacts) the abutted portion 62 of the rib-shaped projection 51.

One end of the urging spring 67 is hooked on the spring hooking hole 66*a* of the engagement lever 66 to urge one of the lower angle portions (front side) of the engagement lever 66 to a rear side. Thus, the urging spring 67 rotates and urges the engagement lever 66 counterclockwise in FIG. 4A. Note that in the strict sense, the other end of the urging spring 67 is fixed to the tail end of a head rotation arm (not shown) used to rotate (press) the print head 32 to the side of the platen roller 44. The lower angle portion of the engagement lever 66 is urged rearward via the urging spring 67 in such a way as to be pulled by the tail end of the head rotation arm.

The cover urging portion 26 rotates and urges the opening/closing cover 13 in a closing direction via the rib-shaped projection 51 in a state in which the opening/closing cover 13 is closed to get across a prescribed closing-side rotation position (prescribed rotation position). While, the cover urging portion 26 rotates and urges the opening/closing cover 13 in an opening direction via the rib-shaped projection 51 in a state in which the opening/closing cover 13 is opened to get across the prescribed closing-side rotation position.

Figure 5A:
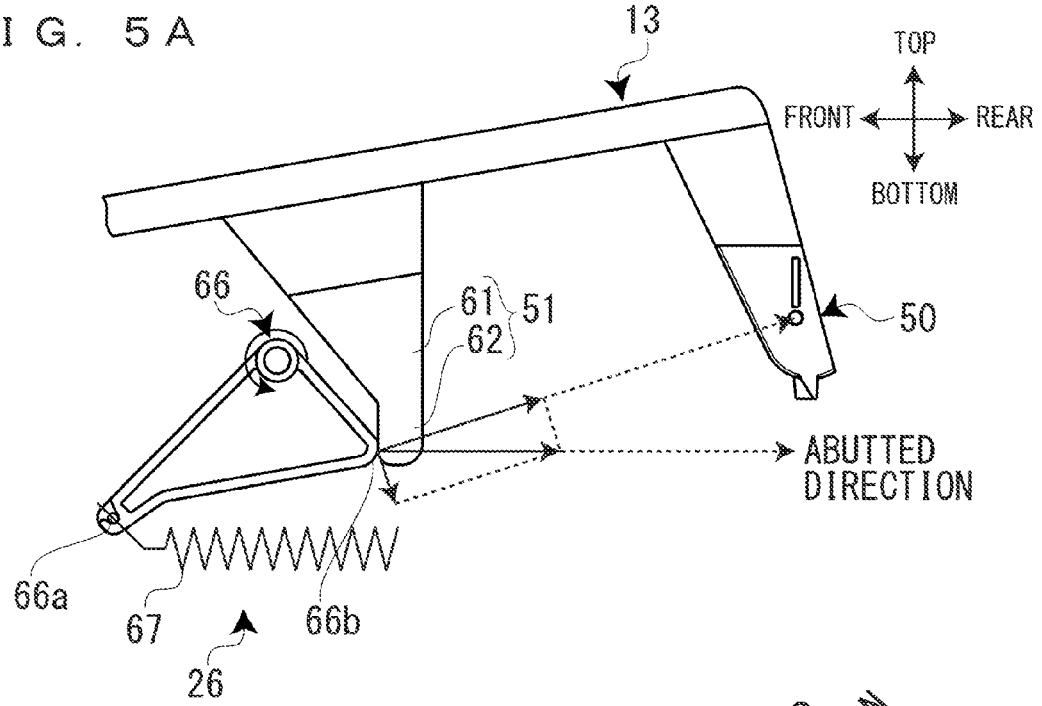
FIGS. 5A and 5B are side views showing the vicinity of a cover urging portion.

Specifically, when the engagement lever 66 rotates and the abutted portion 62 of the rib-shaped projection 51 slides on the engagement lever 66 with the rotation of the opening/closing cover 13, the abutted direction of the engagement lever 66 with respect to the rib-shaped projection 51 changes. Further, as shown in FIG. 5A, in a state in which the opening/closing cover 13 is rotated to a closing side, the rib-shaped projection 51 passes through the angle portion of the engagement lever 66, and the opening/closing cover 13 is rotated to a position to get across the prescribed closing-side rotation position, the abutted direction of the engagement lever 66 with respect to the rib-shaped projection 51 is set at a position lower than a direction from the abutted position to the shaft center of the hinge portion 50. Accordingly, the component of the urging force of the urging spring 67 applied in the abutted direction acts as an urging force to urge the opening/closing cover 13 in the closing direction. Thus, in a state in which the opening/closing cover 13 is closed to get across the prescribed closing-side rotation position, the opening/closing cover 13 is urged in the closing direction.

That is, the prescribed closing-side rotation position is a rotation position at which the abutted direction of the engagement lever 66 with respect to the rib-shaped projection 51 coincides with the direction from the abutted position to the shaft center of the hinge portion 50.

Figure 5B:
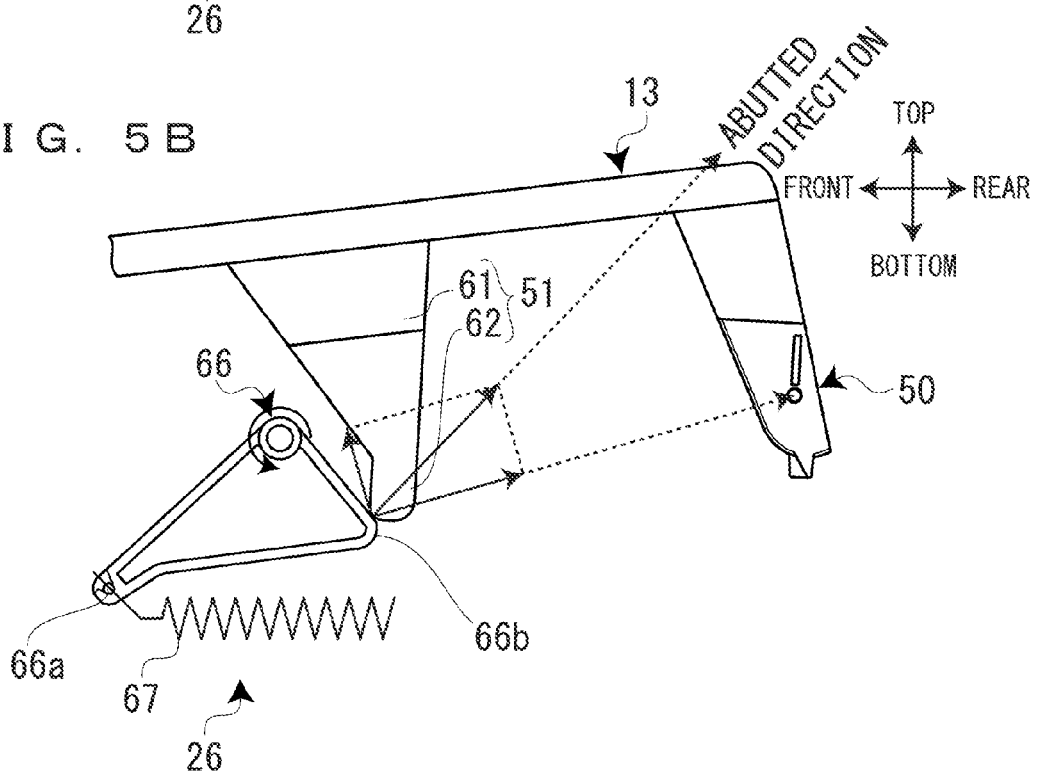

On the other hand, as shown in FIG. 5B, in a state in which the opening/closing cover 13 is rotated to an opening side, the rib-shaped projection 51 passes through the angle portion of the engagement lever 66, and the opening/closing cover 13 is rotated to the position to get across the prescribed closing-side rotation position, the abutted direction of the engagement lever 66 with respect to the rib-shaped projection 51 is set at a position higher than the direction from the abutted direction to the shaft center of the hinge portion 50. Accordingly, the component of the urging force of the urging spring 67 applied in the abutted direction acts as an urging force to urge the opening/closing cover 13 in the closing direction. Thus, in a state in which the opening/closing cover 13 is opened to get across the prescribed closing-side rotation position, the opening/closing cover 13 is urged in the opening direction.

Figure 6:
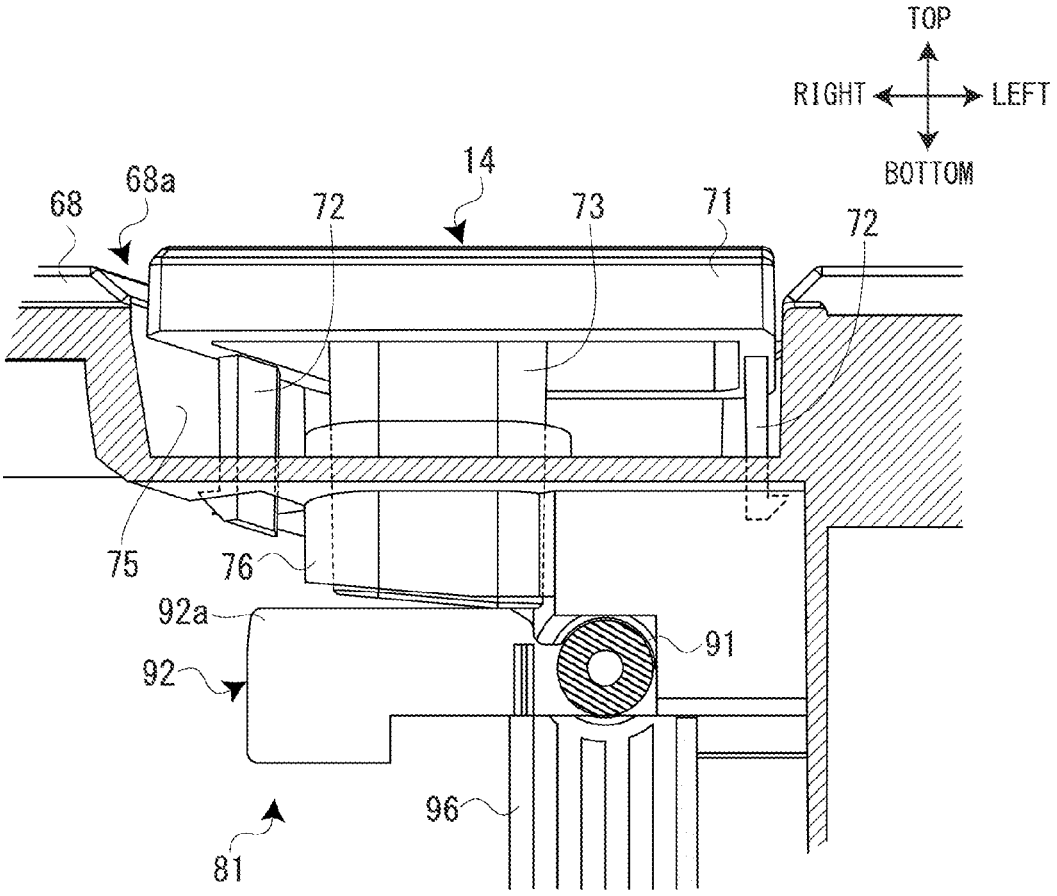
FIG. 6 is a cross-sectional view showing the vicinity of an opening button when seen from its rear side.

FIG. 6 is a cross-sectional view showing the vicinity of the opening button 14 when seen from its rear side. As shown in FIG. 6, the opening button 14 is provided at a button providing portion 68*a* recessed on a ceiling wall 68 of the printer case 11. In addition, the opening button 14 has a button main body 71 serving as a pressed portion, a pair of coming-off prevention hooks 72 projecting downward from the button main body 71 and formed on its right and left sides, and an abutted projection 73 projecting downward from the button main body 71 and formed at its center close to the right side.

While, the button providing portion 68*a* has a loosely-fitting recessed portion 75 in which the button main body 71 loosely fits so as to freely enter and leave, a pair of penetration holes (not shown) formed at the bottom of the loosely-fitting recessed portion 75 and allowing the insertion of the respective coming-off prevention hooks 72, and an insertion guiding portion 76 formed at the bottom of the loosely-fitting recessed portion 75 and allowing the insertion of the abutted projection 73 so as to freely enter and leave.

When the peripheral surface of the button main body 71 and the abutted projection 73 are guided to the loosely-fitting recessed portion 75 and the insertion guiding portion 76, respectively, the opening button 14 is held by the button providing portion 68*a* (the printer case 11) so as to freely enter and leave in the top and bottom direction. In addition, the lower end of the entering and leaving movement of the opening button 14 is restricted when the lower surface of the button main body 71 abuts on the bottom wall of the loosely-fitting recessed portion 75 from above, and the upper end thereof is restricted when the pair of coming-off prevention hooks 72 abuts on the bottom wall of the loosely-fitting recessed portion 75 from below. The abutted projection 73 contacts a leverage member 81 (that will be described later) of the cover locking/pressing-up portion 27. In a state in which the opening button 14 is not pressed, the opening button 14 is pressed up to the upper end of the entering and leaving movement via the abutted projection 73 by the urging force of the leverage member 81. On the other hand, when the opening button 14 is pressed by a user, the abutted projection 73 presses and rotates the leverage member 81. Thus, the opening/closing cover 13 is unlocked and pressed up by the cover locking/pressing-up portion 27.

Figure 7A:
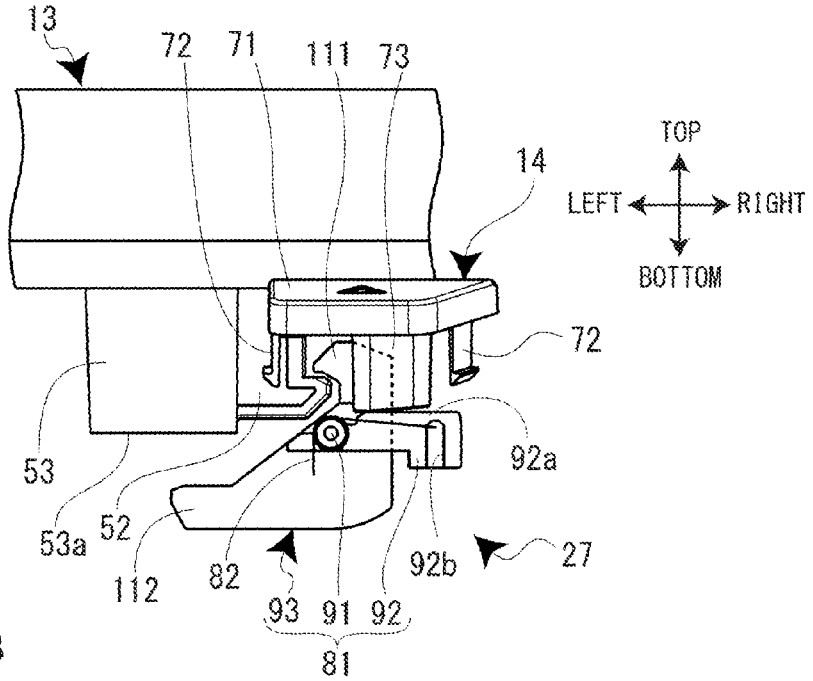
FIGS. 7A and 7B are front views showing the vicinity of a cover locking/pressing-up portion.
Figure 7B:
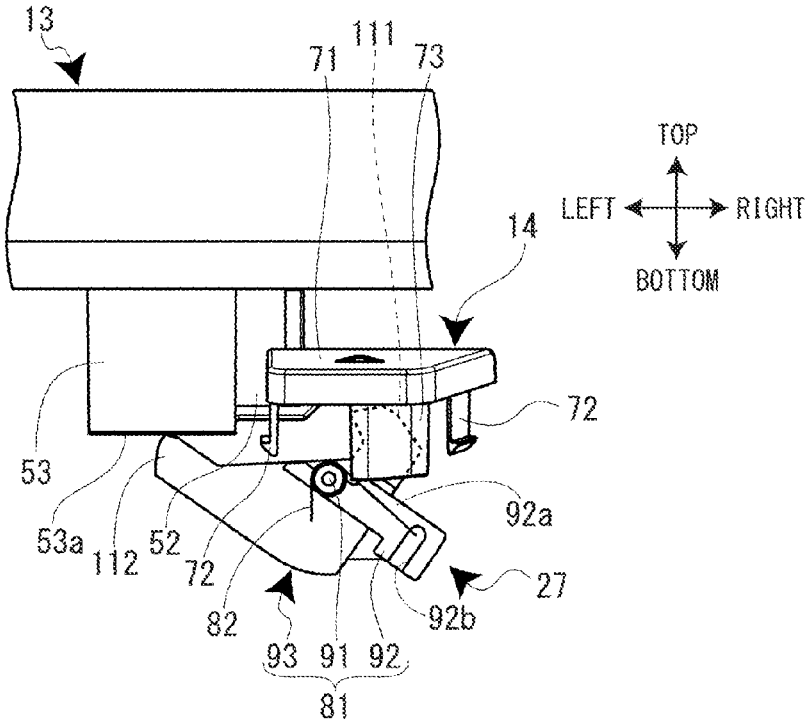

As shown in FIGS. 7A and 7B, the cover locking/pressing-up portion 27 has the leverage member 81 rotatably attached via a rotation shaft 91 and a rotation spring 82 to rotate and urge the leverage member 81. The leverage member 81 has the structure of a first type leverage to convert a force to press the opening button 14 into a force to press the opening/closing cover 13 in the opening direction.

Figure 8A:
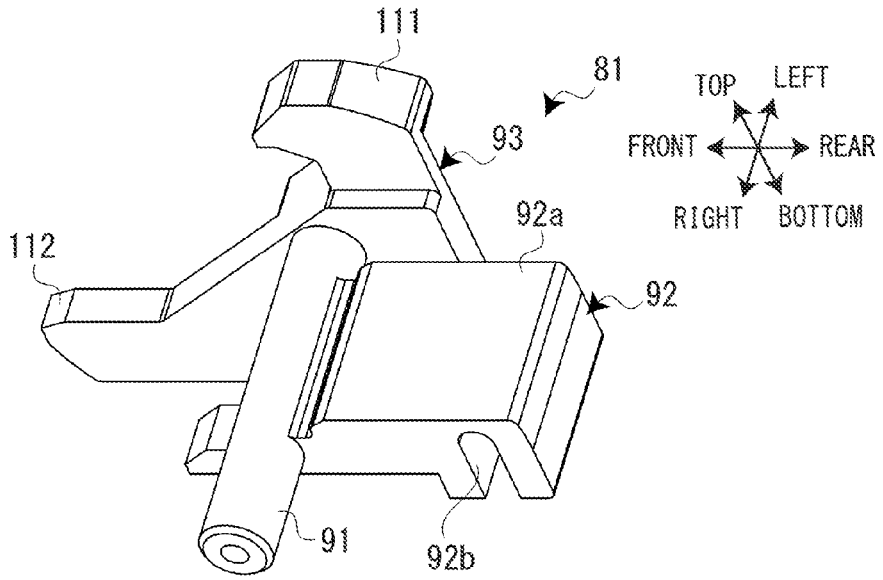
FIGS. 8A and 8B are a perspective view of a leverage member and a cross-sectional view showing the vicinity of the leverage member when seen from its side.
Figure 8B:
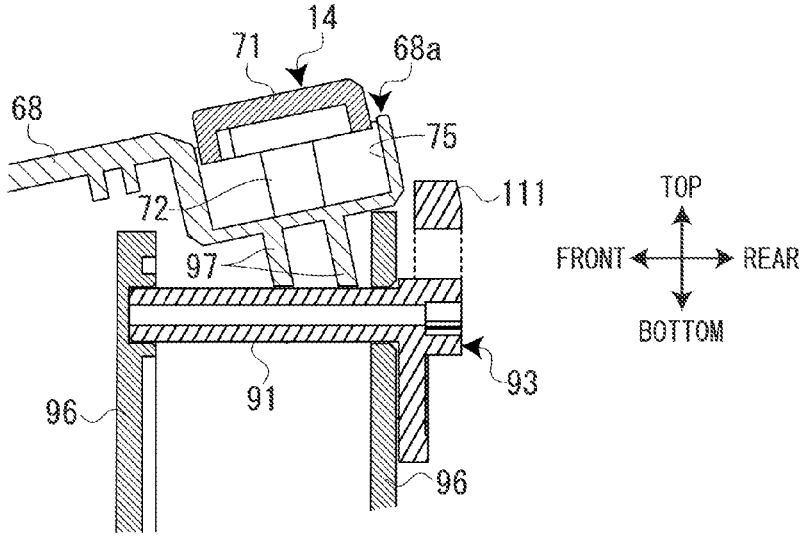

As shown in FIG. 8A, the leverage member 81 has a rotatably-supported rotation shaft 91, a lying reverse "L"-shaped button receiving member 92 fixed at the intermediate position between the front and rear sides of the rotation shaft 91, and a "J"-shaped lever member 93 fixed at one end of the rotation shaft 91. As shown in FIG. 8B, the rotation shaft 91 is pivotally supported at its two front and rear parts by a pair of pivotally-supporting members 96 extending from the bottom wall of the printer frame and pressed from above by a pair of shaft pressing ribs 97 downwardly projecting from the loosely-fitting recessed portion 75 of the printer case 11. That is, the rotation shaft 91 is rotatably held by the pair of pivotally-supporting members 96 and the pair of shaft pressing ribs 97.

As shown in FIGS. 7A and 7B and FIG. 8A, the button receiving member 92 has a projection receiving portion 92*a* on which the abutted projection 73 of the opening button 14 abuts and has a spring hooking portion 92*b*. On the other hand, the lever member 93 has a hooked latching portion 111 formed at its apex and used to latch the latched portion 52 and has a pressing portion 112 formed at its tip end and used to press the pressed portion 53.

One end of the rotation spring 82 is hooked on the spring hooking portion 92*b*, and the other end thereof is hooked on the pivotally-supporting members 96. Thus, the rotation spring 82 rotates and urges the leverage member 81 counterclockwise in FIG. 7B. That is, the button receiving member 92, the latching portion 111, and the pressing portion 112 are urged by the rotation spring 82 to the side of the abutted projection 73, the side of the latched portion 52, and the opposite side of the pressed portion 53, respectively.

As shown in FIG. 7A, in a state in which the opening/closing cover 13 closes the cartridge installation portion 20 (closed state) and the opening button 14 is not pressed, the cover locking/pressing-up portion 27 is brought into a state in which the leverage member 81 rotates counterclockwise due to the rotation and urging of the rotation spring 82, the latching portion 111 latches the latched portion 52, and the pressing portion 112 separates from the pressed portion 53. By latching the latched portion 52 with the latching portion 111 as described above, the cover locking/pressing-up portion 27 locks the opening/closing cover 13 in a state in which the cartridge installation portion 20 is closed (closed state). In addition, due to the rotation and urging of the rotation spring 82, the button receiving member 92 presses up the opening button 14 to the upper end of the entering and leaving movement via the abutted projection 73.

On the other hand, as shown in FIG. 7B, when the opening button 14 is pressed in this state, the button receiving member 92 is pressed by the abutted projection 73 of the opening button 14 to rotate the leverage member 81 clockwise. By the rotation, the latching portion 111 first deviates from the latched portion 52. Then, the pressing portion 112 abuts on the pressed portion 53 and presses up the opening/closing cover 13 via the pressed portion 53. Thus, the opening/closing cover 13 is rotated to the position to get across the prescribed closing-side rotation position. As described above, using the force to press the opening button 14, the cover locking/pressing-up portion 27 unlocks the opening/closing cover 13 and rotates the opening/closing cover 13 to the position to get across the prescribed closing-side rotation position. In addition, the opening/closing cover 13 may be opened simultaneously when it is unlocked.

Next, a description will be given, with reference to FIGS. 9A to 9F and FIGS. 10A to 10H, of the opening/closing operation of the opening/closing cover 13 in the tape printer 1. FIGS. 9A to 9F are explanatory views showing a closing operation to close the opening/closing cover 13. FIGS. 10A to 10H are explanatory views showing an opening operation to open the opening/closing cover 13. First, a description will be given of the closing operation with reference to FIGS. 9A to 9F. As shown in FIGS. 9A to 9F, when the user rotates (presses) the completely-opened opening/closing cover 13 to the closing side by a hand, the engagement lever 66 first engages with the rib-shaped projection 51 (see FIGS. 9A and 9B). Then, the abutted portion 62 of the rib-shaped projection 51 slides on the engagement lever 66, while the engagement lever 66 rotates (see FIGS. 9C and 9D).

Figure 9A:
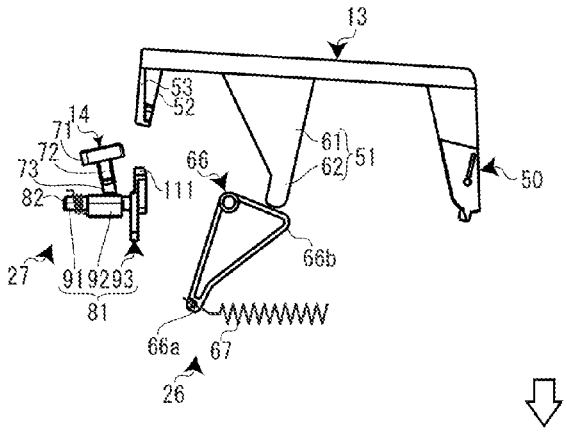
FIGS. 9A to 9F are explanatory views showing the closing operation of the opening/closing cover.
Figure 9B:
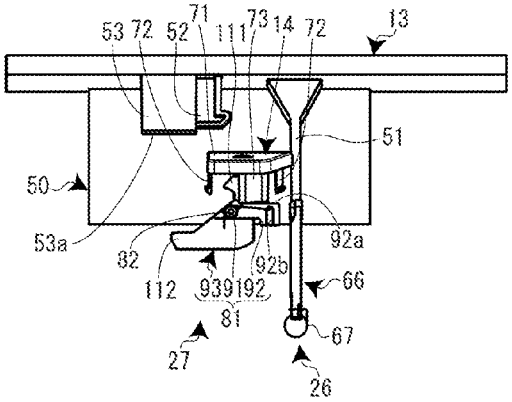
Figure 9C:
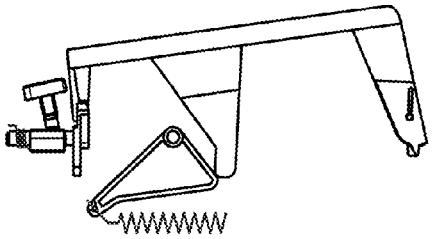
Figure 9D:
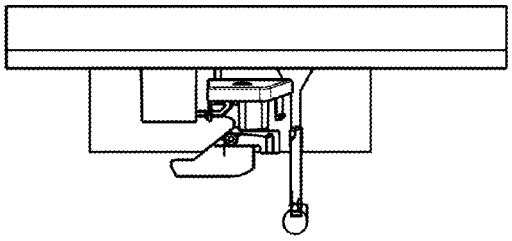
Figure 9E:
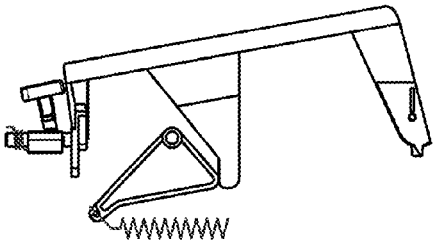
Figure 9F:
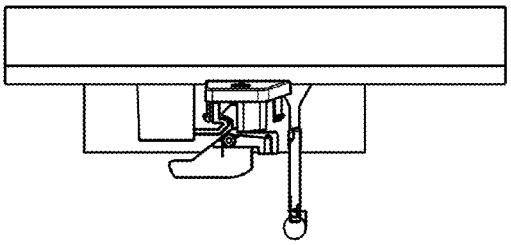
Figure 10A:
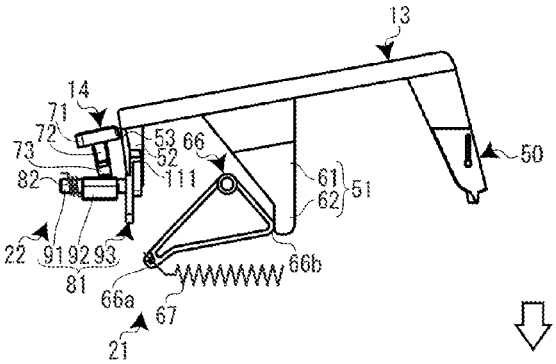
FIGS. 10A to 10H are explanatory views showing the opening operation of the opening/closing cover.
Figure 10B:
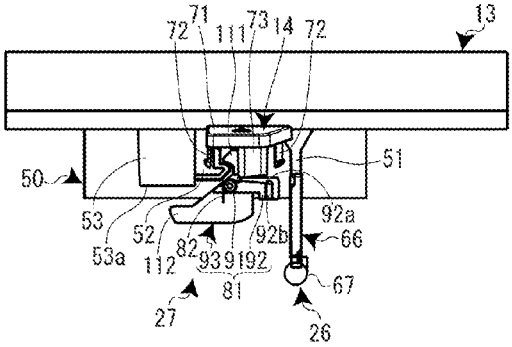
Figure 10C:
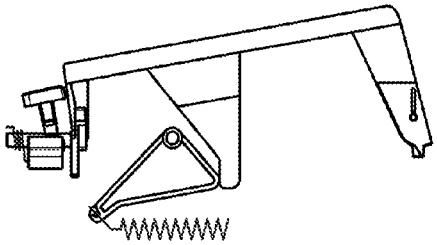
Figure 10D:
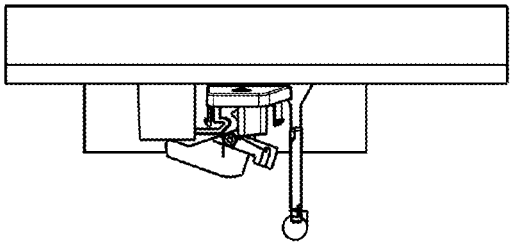
Figure 10E:
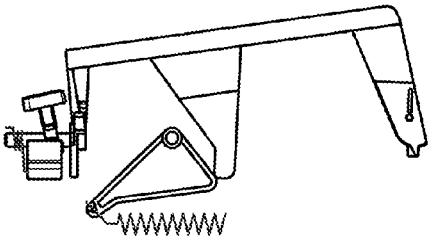
Figure 10F:
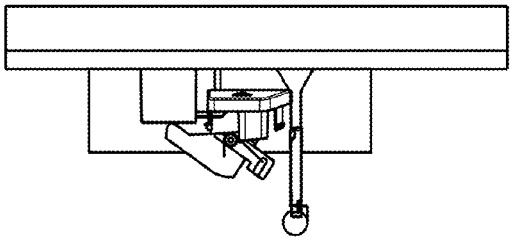
Figure 10G:
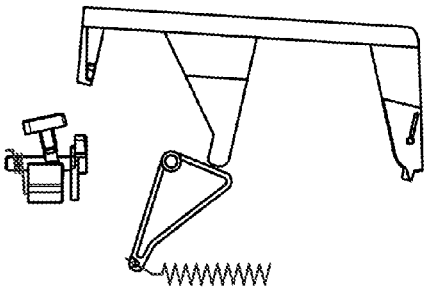
Figure 10H:
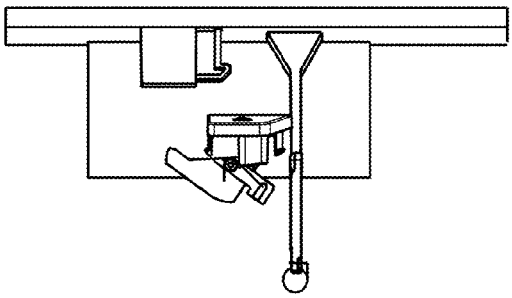

Next, when the opening/closing cover 13 further is rotated to the position to get across the prescribed closing-side rotation position, the abutted direction of the engagement lever 66 with respect to the rib-shaped projection 51 is set at the position lower than the direction from the contact position to the shaft center of the hinge portion 50 and the opening/closing cover 13 is urged in the closing direction by the cover urging portion 26 (see FIGS. 9E and 9F). In addition, at this time, the latching portion 111 of the leverage member 81 latches the latched portion 52. Accordingly, the opening/closing cover 13 is locked in a state in which the cartridge installation portion 20 is closed. In the way described above, the closing operation is completed.

Next, a description will be given of the opening operation. The opening operation starts when the user presses the opening button 14 in a state in which the opening/closing cover 13 covers the cartridge installation portion 20 and the opening/closing cover 13 is locked (see FIGS. 10A and 10B). When the user presses the opening button 14 by a hand (finger), the leverage member 81 rotates clockwise and the latching portion 111 of the leverage member 81 first deviates from the latched portion 52 to unlock the opening/closing cover 13 (see FIGS. 10C and 10D). After that, when the user further presses the opening button 14 to advance the rotation of the leverage member 81, the pressing portion 112 of the leverage member 81 abuts on the pressed portion 53. In addition, the pressing portion 112 presses up the opening/closing cover 13 to the opening side via the pressed portion 53. That is, the pressing portion 112 rotates the opening/closing cover 13 to the opening side against the rotation and urging of the cover urging portion 26 in the closing direction. Accordingly, the rib-shaped projection 51 slides on the engagement lever 66. Then, when the user presses the opening button 14 to the end (presses the opening button 14 to the lower end of the entering and leaving movement), the opening/closing cover 13 is rotated to the position to get across the prescribed closing-side rotation position with the pressing of the pressing portion 112 and the abutted direction of the engagement lever 66 with respect to the rib-shaped projection 51 is set at the position higher than the direction from the abutted position to the shaft center of the hinge portion 50 (see FIGS. 10E and 10D). As a result, the opening/closing cover 13 is urged in the opening direction by the cover urging portion 26 to pop up the opening/closing cover 13 (see FIGS. 10G and 10H). In the way described above, the opening operation is completed.

According to the configuration of the embodiment, since the opening/closing cover 13 is closed and urged (a pulling force acts) in a state in which the opening/closing cover 13 is closed to get across the prescribed rotation position, the rattling of the opening/closing cover 13 may be prevented when the user operates the button group 19 provided on the opening/closing cover 13.

In addition, since the opening/closing cover 13 is opened (rotated) to the position at which the opening/closing cover 13 is opened and urged by the force to press the opening button 14, the user may open the opening/closing cover 13 only by pressing the opening button 14. Thus, the user may easily open the opening/closing cover 13 by a finger. That is, the user may easily open the opening/closing cover 13 in the tape printer 1 in which the opening/closing cover 13 is opened and urged when being opened to get across the prescribed rotation position and in which the opening/closing cover 13 is closed and urged when being closed to get across the prescribed rotation position. Thus, the usability of the tape printer 1 may be improved.

In addition, since the locking/pressing-up portion 27 has the locking mechanism to lock the opening/closing cover 13 in a state in which the cartridge installation portion 20 is closed (closed state), the opening of the opening/closing cover 13 due to impact or the like may be prevented.

Moreover, since the cover locking/pressing-up portion 27 unlocks the opening/closing cover 13 with the force to press the opening button 14, the user may unlock and open the opening/closing cover 13 only by pressing the opening button 14. Accordingly, the user does not feel burdened on operating the unlocking of the opening/closing cover 13. Therefore, the usability may be further improved.

Note that although the integrated cover locking/pressing-up portion 27 in the embodiment constitutes the cover locking portion to lock the opening/closing cover 13 in a state in which the cartridge installation portion 20 is closed (closed state) and the cover pressing-up portion to press up the opening/closing cover 13 to the prescribed closing-side rotation position, the cover locking portion and the cover pressing-up portion may be separately provided. In addition, the cover locking portion (the cover locking structure of the cover locking/pressing-up portion 27) may be omitted.

In addition, although the cover pressing-up portion includes the leverage member 81 in the embodiment, any other cover pressing-up portion may be employed so long as it is capable of converting the force to press the opening button 14 into the force to press up the opening button 14.

What is claimed is:

1. A tape printer comprising:

a cartridge installation portion to install a tape cartridge;

an opening/closing cover that rotates about a hinge portion to open/close the cartridge installation portion;

a cover urging portion that rotates and urges the opening/closing cover in an opening direction in a state in which the opening/closing cover is rotated to an opening side to get across a prescribed rotation position and that rotates and urges the opening/closing cover in a closing direction in a state in which the opening/closing cover is rotated to a closing side to get across the prescribed rotation position; and a cover opening operation portion that has an opening button and rotates the opening/closing cover to the opening side to get across the prescribed rotation position with a force to press the opening button, wherein the cover opening operation portion includes the opening button, a leverage member that is rotatably supported by a rotation shaft and converts the force to press the opening button into a force to press the opening/closing cover in the opening direction when the opening button abuts on the leverage member to rotate in one direction, and a rotation spring that rotates and urges the leverage member in a direction opposite to the one direction.

* * * * *